US010582288B2

(12) United States Patent
Kirsch et al.

(10) Patent No.: US 10,582,288 B2
(45) Date of Patent: Mar. 3, 2020

(54) SPORTS HEADPHONE WITH SITUATIONAL AWARENESS

(71) Applicant: Harman International Industries, Incorporated, Stamford, CT (US)

(72) Inventors: James M. Kirsch, Salt Lake City, UT (US); Jeffrey Hutchings, Sandy, UT (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 15/575,302

(22) PCT Filed: Jun. 26, 2015

(86) PCT No.: PCT/US2015/038158
§ 371 (c)(1),
(2) Date: Nov. 17, 2017

(87) PCT Pub. No.: WO2016/209295
PCT Pub. Date: Dec. 29, 2016

(65) Prior Publication Data

US 2018/0160211 A1 Jun. 7, 2018

(51) Int. Cl.
*H04R 1/10* (2006.01)
*H04R 5/033* (2006.01)

(52) U.S. Cl.
CPC ..... *H04R 1/1041* (2013.01); *H04R 1/1083* (2013.01); *H04R 5/033* (2013.01); *H04R 2430/01* (2013.01)

(58) Field of Classification Search
CPC .... H04R 1/1041; H04R 1/1083; H04R 5/033; H04R 2430/01
See application file for complete search history.

(56) References Cited

U.S. PATENT DOCUMENTS 4,855,723 A * 8/1989 Fritz ..... G08B 7/064 340/691.5
7,558,636 B2 * 7/2009 Arndt ..... G10L 21/0208 381/94.1

(Continued)

FOREIGN PATENT DOCUMENTS

JP H06- 233388 A 8/1994
JP 2008-134582 A 6/2008

(Continued)

OTHER PUBLICATIONS

International Search Report for Application No. PCT/US2015/038158, dated Mar. 25, 2016, 3 pages.

*Primary Examiner* — Sonia L Gay
(74) *Attorney, Agent, or Firm* — Artegis Law Group, LLP

(57) ABSTRACT

One or more embodiments set forth an audio processing system for a personal listening device that includes a set of microphones, a noise reduction module, an audio ducker, and a mixer. The set of microphones is configured to receive a first set of audio signals from an environment. The noise reduction module is configured to detect when a signal of interest is present in the first plurality of audio signals, and, upon detecting a signal of interest, transmit a ducking control signal. The audio ducker is configured to receive the ducking control signal, and receive a second plurality of audio signals via a playback device. The audio ducker is further configured to reduce an amplitude of a second plurality of audio signals relative to the signal of interest based on the ducking control signal. The mixer combines the first plurality of audio signals and second plurality of audio signals.

20 Claims, 5 Drawing Sheets

(56) References Cited

U.S. PATENT DOCUMENTS

2003/0044023 A1* 3/2003 Larsen ..... H04R 5/04 381/61
2003/0220705 A1* 11/2003 Ibey ..... H04R 5/04 700/94
2005/0078842 A1* 4/2005 Vonlanthen ..... H04R 25/43 381/312
2008/0267416 A1* 10/2008 Goldstein ..... H04R 1/1091 381/56
2009/0046868 A1* 2/2009 Engle ..... H04R 1/1041 381/74
2009/0076636 A1* 3/2009 Bradford ..... G10L 21/02 700/94
2012/0155674 A1* 6/2012 Matsuo ..... G10L 21/0208 381/107
2013/0013303 A1* 1/2013 Strommer ..... G10L 21/02 704/226
2013/0272543 A1* 10/2013 Tracey ..... H03G 3/32 381/107
2013/0329908 A1* 12/2013 Lindahl ..... G10L 21/0208 381/92
2014/0044269 A1* 2/2014 Anderson ..... H04R 5/04 381/57
2015/0078597 A1 3/2015 Andrea
2015/0304774 A1* 10/2015 Ambrose ..... H04R 1/10 381/74
2016/0034417 A1* 2/2016 Chavez ..... H04B 3/542 710/110
2016/0099007 A1* 4/2016 Alvarez ..... G10L 21/034 704/225
2016/0192073 A1* 6/2016 Poornachandran ..... G10L 25/51 381/26

FOREIGN PATENT DOCUMENTS

JP 2011-199699 A 10/2011
KR 2020080000095 U 1/2008
KR 10-2009-0034224 A 4/2009
KR 1020110014878 A 2/2011
WO 2014133346 A1 9/2014

* cited by examiner

SPORTS HEADPHONE WITH SITUATIONAL AWARENESS

CROSS-REFERENCE TO RELATED APPLICATIONS

The present application is a national stage application of the international application titled, "SPORTS HEADPHONE WITH SITUATIONAL AWARENESS," filed on Jun. 26, 2015 and having application number PCT/US2015/0038158. The subject matter of this related application is hereby incorporated herein by reference.

BACKGROUND

Field of the Embodiments of the Present Disclosure

Embodiments of the present disclosure relate generally to audio signal processing and, more specifically, to a sports headphone with situational awareness.

Description of the Related Art

Headphones, earphones, earbuds, and other personal listening devices are commonly used by individuals who desire to listen to an audio source, such as music, speech, or movie soundtracks, without disturbing other people in the nearby vicinity. In order to provide good quality audio, such devices typically cover the entire ear or completely seal the ear canal. Typically, these devices include an audio plug for insertion into an audio output of an audio playback device. The audio plug connects to a cable that carries the audio signal from the audio playback device to a pair of headphones or earphones that are placed over or inserted into the listener's ears. As a result, the headphones or earphones provide a good acoustic seal, thereby reducing audio signal leakage and improving the quality of the listener's experience, particularly with respect to bass response.

One problem with the above devices is that, because the devices form a good acoustic seal with the ear, the ability of the listener to hear environmental sound is substantially reduced. As a result, the listener may be unable to hear certain important sounds from the environment, such as an oncoming vehicle, an announcement over an intercom system, or an alarm. In one example, a bicyclist riding within a paceline could be listening to music but would still like to hear the voices of other bicyclists in the paceline riding to the front and rear. In another example, a diner could be listening to music while waiting for an announcement that the diner's table is ready.

One solution to the above problems is to acoustically or electronically mix audio from the environment with the audio signal received from the playback device. The listener is then able to hear both the audio from the playback device and the audio from the environment. One drawback with such solutions, though, is that the listener typically hears all audio from the environment rather than just the specific environmental sounds that the listener desires to hear. As a result, the quality of the listener's experience can be substantially reduced.

As the foregoing illustrates, a more effective technique for providing both playback audio and environmental sound to a personal listening device would be useful.

SUMMARY

One or more embodiments set forth an audio processing system for a personal listening device that includes a set of microphones, a noise reduction module, an audio ducker, and a mixer. The set of microphones is integrated into the personal listening device and configured to receive a first set of audio signals from an environment. The noise reduction module is coupled to the first plurality of microphones and configured to detect when a signal of interest is present in the first plurality of audio signals, and, upon detecting a signal of interest, transmit a ducking control signal. The audio ducker is coupled to the noise reduction module and configured to receive the ducking control signal, and receive a second plurality of audio signals via a playback device. The audio ducker is further configured to reduce an amplitude of a second plurality of audio signals relative to the signal of interest based on the ducking control signal. The mixer is coupled to the audio ducker and configured to combine the first plurality of audio signals and second plurality of audio signals.

Other embodiments include, without limitation, a computer readable medium including instructions for performing one or more aspects of the disclosed techniques, as well as a method for performing one or more aspects of the disclosed techniques.

At least one advantage of the disclosed approach is that a listener who uses the disclosed personal listening device hears a high-quality audio signal from a playback device plus certain audio sounds of interest from the environment, while, at the same time, other sounds from the environment are suppressed relative to the sounds of interest. As a result, the potential for the listener to hear only desired audio signals is improved, leading to a better quality audio experience for the listener.

BRIEF DESCRIPTION OF THE SEVERAL VIEWS OF THE DRAWINGS

So that the manner in which the recited features of the one more embodiments set forth above can be understood in detail, a more particular description of the one or more embodiments, briefly summarized above, may be had by reference to certain specific embodiments, some of which are illustrated in the appended drawings. It is to be noted, however, that the appended drawings illustrate only typical embodiments and are therefore not to be considered limiting of its scope in any manner, for the scope of the disclosure subsumes other embodiments as well.

DETAILED DESCRIPTION

In the following description, numerous specific details are set forth to provide a more thorough understanding of certain specific embodiments. However, it will be apparent to one of skill in the art that other embodiments may be practiced without one or more of these specific details or with additional specific details.

System Overview

Figure 1:
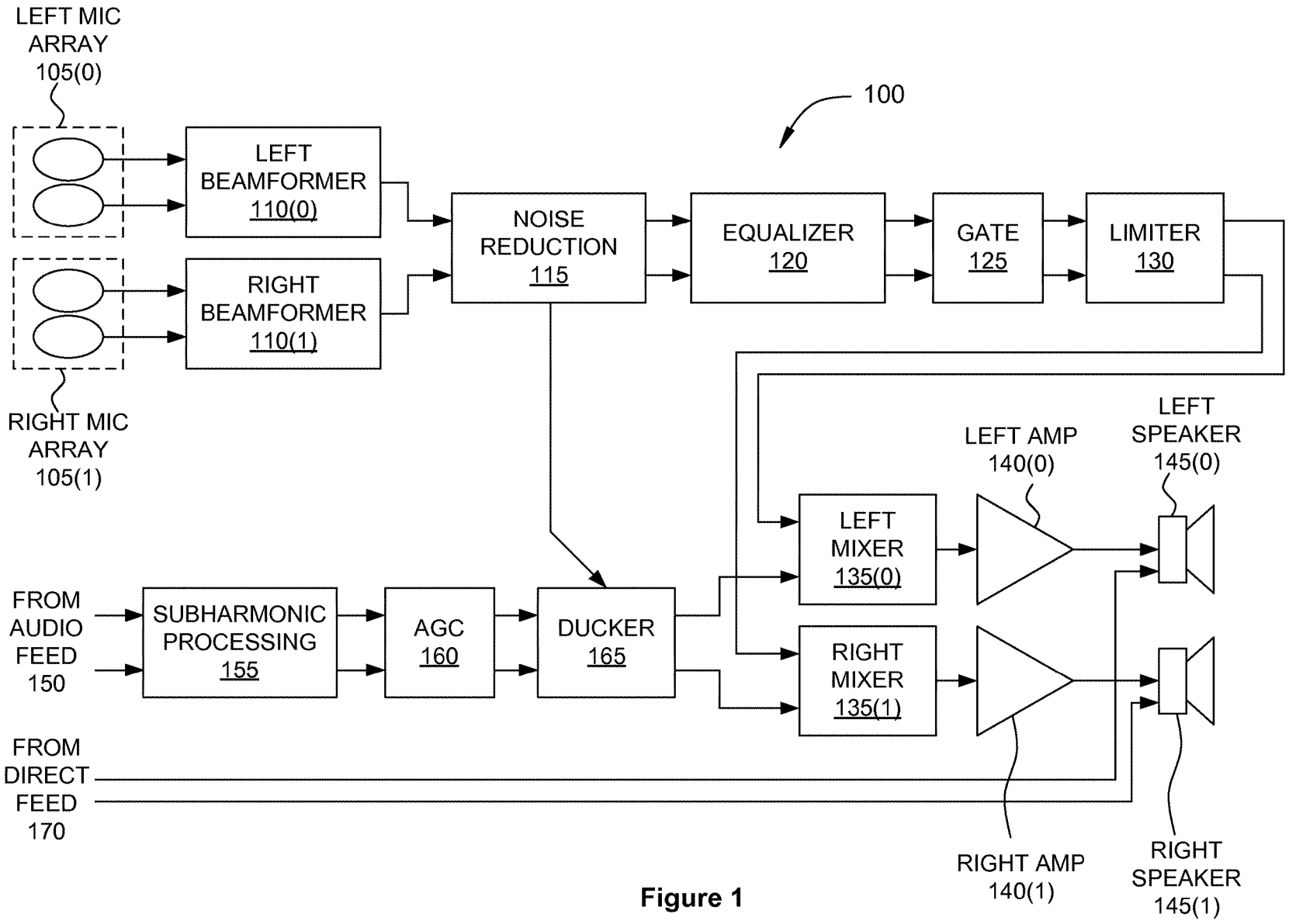
FIG. 1 illustrates an audio processing system configured to implement one or more aspects of the various embodiments.

FIG. 1 illustrates an audio processing system 100 configured to implement one or more aspects of the various embodiments. As shown, the audio processing system 100 includes, without limitation, microphone (mic) arrays 105(0) and 105(1), beamformers 110(0) and 110(1), noise reduction 115, an equalizer 120, a gate 125, a limiter 130, mixers 135(0) and 135(1), amplifiers (amps) 140(0) and 140(1), speakers 145(0) and 145(1), subharmonic processing 155, automatic gain control (AGC) 160 and a ducker 165.

In various embodiments, audio processing system 100 may be implemented as a state machine, a central processing unit (CPU), digital signal processor (DSP), a microcontroller, an application-specific integrated circuit (ASIC), or any device or structure configured to process data and execute software applications. In some embodiments, one or more of the blocks illustrated in FIG. 1 may be implemented with discrete analog or digital circuitry. In one example, and without limitation, the left amplifier 140(0) and right amplifier 140(1) could be implemented with operational amplifiers.

Microphone arrays 105(0) and 105(1) receive audio from the physical environment. Microphone array 105(0) receives audio from the physical environment in the vicinity of the left ear of the listener. Correspondingly, microphone array 105(1) receives audio from the physical environment in the vicinity of the right ear of the listener. Each of microphone arrays 105(0) and 105(1) includes multiple microphones. Although illustrated as including two microphones each, microphone arrays 105(0) and 105(1) may include more than two microphones each within the scope of the present disclosure. Because microphone arrays 105(0) and 105(1) include multiple microphones, beamformers 110(0) and 110(1) are able to spatially filter environmental audio in a directional manner, as further described herein. Microphone arrays 105(0) and 105(1) transmit the received audio to beamformers 110(0) and 110(1), respectively.

Beamformers 110(0) and 110(1) receive audio signals from microphone arrays 105(0) and 105(1), respectively. Beamformers 110(0) and 110(1) process the received audio signals according to one of a number of modes, where the modes include, without limitation, omnidirectional mode, dipole mode, and cardioid mode. In various embodiments, the mode may be preprogrammed by the manufacturer or may be a user-selectable setting.

Beamformers 110(0) and 110(1) measure the strength of the received audio from each microphone in corresponding microphone arrays 105(0) and 105(1) to determine the direction of the incoming audio. In some embodiments, the signal received from one of the microphones in microphone arrays 105(0) and 105(1) is digitally delayed and then subtracted from the signal from another one of the microphones in the microphone arrays 105(0) and 105(1).

Depending on the selected mode, beamformers 110(0) and 110(1) amplify signals originating from certain directions while attenuating signals originating from other directions. For example, and without limitation, if the selected mode is omnidirectional mode, then beamformers 110(0) and 110(1) would amplify signals originating from all directions equally. If the selected mode is dipole mode, also referred to herein as "FIG. 8" mode, then beamformers 110(0) and 110(1) could amplify audio signals originating from two directions, typically from the front and back directions, while suppressing audio signals originating from other directions, typically from the left and the right directions. If the selected mode is cardioid mode, then beamformers 110(0) and 110(1) could amplify audio signals originating from most directions, such as from lateral directions and from above, while suppressing audio signals originating from a particular direction, such as from below the listener. Alternatively, if the selected mode is cardioid mode, then beamformers 110(0) and 110(1) could amplify audio signals originating from in front of the listener, while suppressing audio signals originating from behind the listener. After beamformers 110(0) and 110(1) have amplified and suppressed signals received from respective microphone arrays 105(0) and 105(1) according to the selected mode, beamformers 110(0) and 110(1) transmit the resulting audio signal to noise reduction 115.

Noise reduction 115 is a module that receives audio signals from beamformers 110(0) and 110(1). Noise reduction 115 analyzes the received audio signal, suppresses signals determined to be of less interest, such as steady-state or noise signals, and passes signals determined to be signals of interest, such as transient signals. In some embodiments, noise reduction 115 may analyze the received signal in the frequency domain over a period of time. In such embodiments, noise reduction 115 may convert the received signal into the frequency domain and divide the frequency domain into relevant bins, where each bin corresponds to a specific frequency range. Noise reduction 115 may measure the amplitude across multiple samples over time in order to determine which frequency bins correspond to a steady-state signal and which frequency bins correspond to transient signals. In general, steady-state signals may correspond to background noise, including, without limitation, traffic din, hum, hiss, rain, and wind. If a particular frequency bin is associated with an amplitude that remains relatively constant over time, noise reduction 115 may determine that the frequency bin is associated with a steady-state signal. Noise reduction 115 may attenuate such steady-state signals.

On the other hand, transient signals may correspond to signals of interest, including, without limitation, human speech, honking automobile horns, and sirens. If a particular frequency bin is associated with an amplitude that fluctuates significantly over time, noise reduction 115 may determine that the frequency bin is associated with a transient signal. Noise reduction 115 may pass such transient signals to equalizer 120 and optionally may amplify the transient signals.

In one example, and without limitation, noise reduction 115 could analyze 256 frequency domain samples, where the frequency domain samples would be evenly distributed over a period of 1 second. Noise reduction 115 would analyze the 256 samples with respect to each frequency bin in order to determine which frequency bins to determine which bins are associated with steady-state signals and which bins are associated with transient signals. Noise reduction could then analyze another 256 frequency domain samples. Each set of 256 frequency domain samples could have a specified overlap with a preceding set of 256 frequency domain samples and a subsequent set of 256 frequency domain samples. If the overlap is specified to be 50%, then each set of 256 frequency domain samples would include the last 128 samples of the immediately preceding set of samples and the first 128 samples of the immediately following set of samples. In some embodiments, noise reduction 115 may perform operations in the time domain without first transforming into the frequency domain. In such embodiments, noise reduction 115 may include multiple parallel bandpass filters (not explicitly shown) corresponding to the frequency bins described herein.

In addition, noise reduction 115 produces a control signal that identifies when noise reduction 115 detects a signal of interest in the environment of the listener. In general, a signal of interest includes any sounds from the environment that are not low-level, steady-state sounds, including, without limitation, human speech, an automobile horn, sounds of an oncoming vehicle, and an alarm. These types of important sounds emanating from the environment are typically characterized as an audio signal that has a high audio level relative to the average background audio level and is intermittent, acting as an interruption. Stated another way, a signal of interest includes any intermittent audio sound having a high audio level relative to the average audio signal level received by microphone arrays 150(0) and 150(1). If noise reduction 115 detects such a signal, then noise reduction 115 transmits a corresponding signal to ducker 165, as further described herein. In various embodiments, noise reduction 115 may reduce noise in the received signal via other approaches, including, without limitation, spectral subtraction and speech detection, recognition, and extraction.

In some embodiments, noise reduction 115 may also include active noise cancellation (ANC) functionality (not explicitly shown). In such embodiments, noise reduction 115 may perform an ANC function with respect to frequency bins associated with frequencies at or below a threshold frequency, such as 200 Hz. Noise reduction 115 may perform a noise reduction function, as described herein, with respect to frequency bins associated with frequencies above the threshold frequency, such as 200 Hz.

After performing noise reduction and optionally performing ANC, noise reduction 115 transmits the resulting audio signal to equalizer 120.

Equalizer 120 receives audio signals from noise reduction 115. Equalizer 120 performs frequency-based amplitude adjustments on the received audio signals in order to improve audio quality for audio signals received from the environment of the listener. Environmental studio signals that reach the listener's ears via microphone arrays 110(0) and 110(1) of audio processing system 100 typically sound different to the listener relative to the same audio sounds that reach the listener's ears when audio processing system 100 is not being used. Such acoustic differences result from acoustic changes that occur due to covering the ears with headphones or inserting earphones into the ear canals. Equalizer 120 compensates for such differences by selectively increasing, decreasing, or maintaining volume levels in various frequency bands in the audible range.

In some embodiments, equalizer 120 may amplify audio signals in certain frequency bands in order to make such audio signals more noticeable to the user, even if such amplification renders the audio signal less natural sounding. In this way, equalizer 120 may amplify certain audio signals, such as speech or alarms, so that the listener may readily hear these certain audio signals. For example, and without limitation, equalizer 120 could amplify signals that occur in frequency bands corresponding to human speech. As a result, the listener would readily hear human speech via the environment, even if the resulting audio signal sounds less natural to the listener. In some embodiments, equalizer 120 may filter out signals in a certain frequency range that are not of interest to the listener. In one example, and without limitation, equalizer 120 could filter out signals with frequencies below 120 Hz, where such signals could be associated with background noise. Equalizer 120 transmits the equalized audio signal to gate 125.

Gate 125 receives audio signals from equalizer 120 and suppresses audio signals that fall below a threshold volume, or amplitude, level. Audio signals above the threshold volume, or amplitude, level pass through gate 125 to limiter 130. As a result, gate 125 further suppresses low level audio signals, such as hiss and hum. In some embodiments, the threshold level may be constant across the relevant frequency band. In other embodiments, the threshold level may vary across the relevant frequency band. In these latter embodiments, the gate threshold level may be higher in certain frequency bands and lower in other frequency bands. In other words, the gating function performed by gate 125 is a function of the audio signal frequency. Gate 125 transmits the resulting audio signal to limiter 130.

Limiter 130 rapidly detects loud sounds before such loud signals reach the listener's ears and limits such loud signals so as not to exceed a maximum allowable audio level. In this way, limiter 130 attenuates loud signals to protect the listener. In one example, and without limitation, limiter 130 could have a maximum allowable audio level of 95 dB SPL. In such cases, if limiter 130 receives audio signals that exceed 95 dB SPL, then limiter 130 would attenuate the audio signal such that the resulting audio signal would not exceed 95 dB SPL. In some embodiments, limiter 130 may also perform a compression function such that the audio level limiting occurs gradually as the volume increase, rather than abruptly clipping all audio signals above the maximum allowable audio level. Generally, such dynamic range processing leads to a more comfortable listening experience because large volume fluctuations are reduced. Limiter transmits the resulting audio signal to mixers 135(0) and 135(1).

Subharmonic processing 155 receives audio signals from a playback device (not explicitly shown) from an audio feed 150. Subharmonic processing 155 receives these audio signals via any technically feasible technique, including, without limitation, a hard-wired connection, a Bluetooth or Bluetooth LE connection, and a wireless Ethernet connection. Subharmonic processing 155 synthesizes and boosts audio signals that are subharmonic signals of the received audio signal. Such subharmonic synthesis mixes, or combines, the received audio signals with the synthesized subharmonic signals to produce a resulting audio signal with a higher bass level relative to audio signals that have not been so processed. Certain listeners may prefer subharmonic processing 155 while other listeners may not prefer such processing. Yet other listeners may prefer subharmonic processing 155 for some genres but not prefer such processing for other genres. In some embodiments, a listener may control whether subharmonic processing 155 is enabled and may also control the level of subharmonic boost performed by subharmonic processing 155. Subharmonic processing 155 transmits the resulting audio signal to automatic gain control 160.

Automatic gain control 160 receives audio signals from subharmonic processing 155. Automatic gain control 160 amplifies the audio level of quieter sounds and reduces the level of louder sounds to produce a more consistent output volume over time. Automatic gain control 160 is tuned with a fixed target audio level of the received audio signals. Typically, the fixed target audio level is a factory setting established by the manufacturer during product development and manufacturing. In one embodiment, this fixed target audio level is −24 dB. Automatic gain control 160 then determines that a portion of the received audio signals differs from this fixed target audio level. Automatic gain control 160 calculates a scaling factor such that, when the received audio signals are multiplied by the scaling factor, the resulting audio signals are closer to the fixed target audio level. In one example, and without limitation, songs could be mastered at different volume levels based on various factors, such as the time period when the songs were produced and the genre of the songs. If the listener selects songs with varying master record levels, then the listener could experience difficulty listening to these songs. If the listener adjusts the volume level to listen to a quiet song, then the volume could be uncomfortably loud when a louder song is played. Likewise, if the listener adjusts the volume level to listen to a loud song, then the volume could be too low to hear a quieter song. Automatic gain control 160 processes received audio signals such that listening volume of the music would be more consistent over time.

Ducker 165 receives audio signals from automatic gain control 160. Ducker also receives a control signal from noise reduction 115. This control signal identifies if and when noise reduction 115 detects a signal of interest in the environment of the listener. If such a signal is detected, then ducker 165 temporarily reduces the volume level of the received audio signal. In this manner, ducker 165 reduces, or ducks, the audio from the playback device when a signal of interest is received from the environment. As a result, the listener more readily hears signals of interest from the environment. In other words, when a signal of interest is present on microphone arrays 105(0) and 105(1), ducker 165 temporarily reduces, or ducks, the music level so that the signal of interest can be heard and understood. Ducker 165 transmits the resulting audio signals to mixers 140(0) and 140(1).

Mixers 135(0) and 135(1) receive processed environmental audio signals from limiter 130 and processed music or other audio from ducker 165. Mixer 135(0) mixes, or combines, received audio signals for the left audio channel, and, correspondingly, mixer 135(1) mixes received audio signals for the right audio channel. In some embodiments, mixers 135(0) and 135(1) may perform a simple additive or multiplicative mix of the received audio signals. In other embodiments, mixers 135(0) and 135(1) may weight each of the incoming audio signals based on the user volume settings. In these latter embodiments, a louder audio signal received from ducker 165, such as when the listener increases the listening volume, causes the audio signal received from limiter 130 to increase, but perhaps by a different amount relative to the audio signal from ducker 165. After performing the mix function, left mixer 135(0) and right mixer 135(1) transmit the resulting signals to left amplifier 140(0) and right amplifier 140(1). Left amplifier 140(0) and right amplifier 140(1) amplify the received audio signals based on a volume control (not explicitly shown), and transmit the resulting audio signal to left speaker 145(0) and right speaker 145(1), respectively. Left speaker 145(0) and right speaker 145(1) also receive an audio signal from a direct feed 170. Direct feed represents an acoustic signal received from the environment of the listener. If the audio processing system 100 is no longer functioning, such as when the battery power source drops below a threshold voltage level, left speaker 145(0) and right speaker 145(1) transmit the signal from the direct feed 170 rather than the processed audio signal received from left amplifier 140(0) and right speaker 140(1), respectively.

In some embodiments, the listener may control certain functions or set certain parameters of audio processing system 100 via one or more capacitive touch sensors (not explicitly shown). When the listener touches such a sensor, a change in capacitance of the capacitive touch sensor is detected. Such a change in capacitance causes audio processing system 100 to perform a function, including, without limitation, changing a beamforming mode, and changing a filter parameter. The listener may control certain functions or set certain parameters of audio processing system 100 via multiple capacitive touch sensors that detect movement. For example, and without limitation, if three or more capacitive touch sensors are arranged in a vertical line, the listener could increase a volume level by touch the lower capacitive touch sensor with a finger and moving the finger vertically to the middle and the upper capacitive touch sensors. Correspondingly, the listener could decrease a volume level by touch the upper capacitive touch sensor with a finger and moving the finger vertically to the middle and the lower capacitive touch sensors. In other embodiments, the listener may control certain functions or set certain parameters of audio processing system 100 via an application that executes on a computing device, including, without limitation, a smartphone, a tablet computer, or a laptop computer. Such an application may communicate with audio processing system 100 via any technically feasible approach, including, without limitation, Bluetooth, Bluetooth LE, and wireless Ethernet.

Operations of the Audio Processing System

Figure 2:
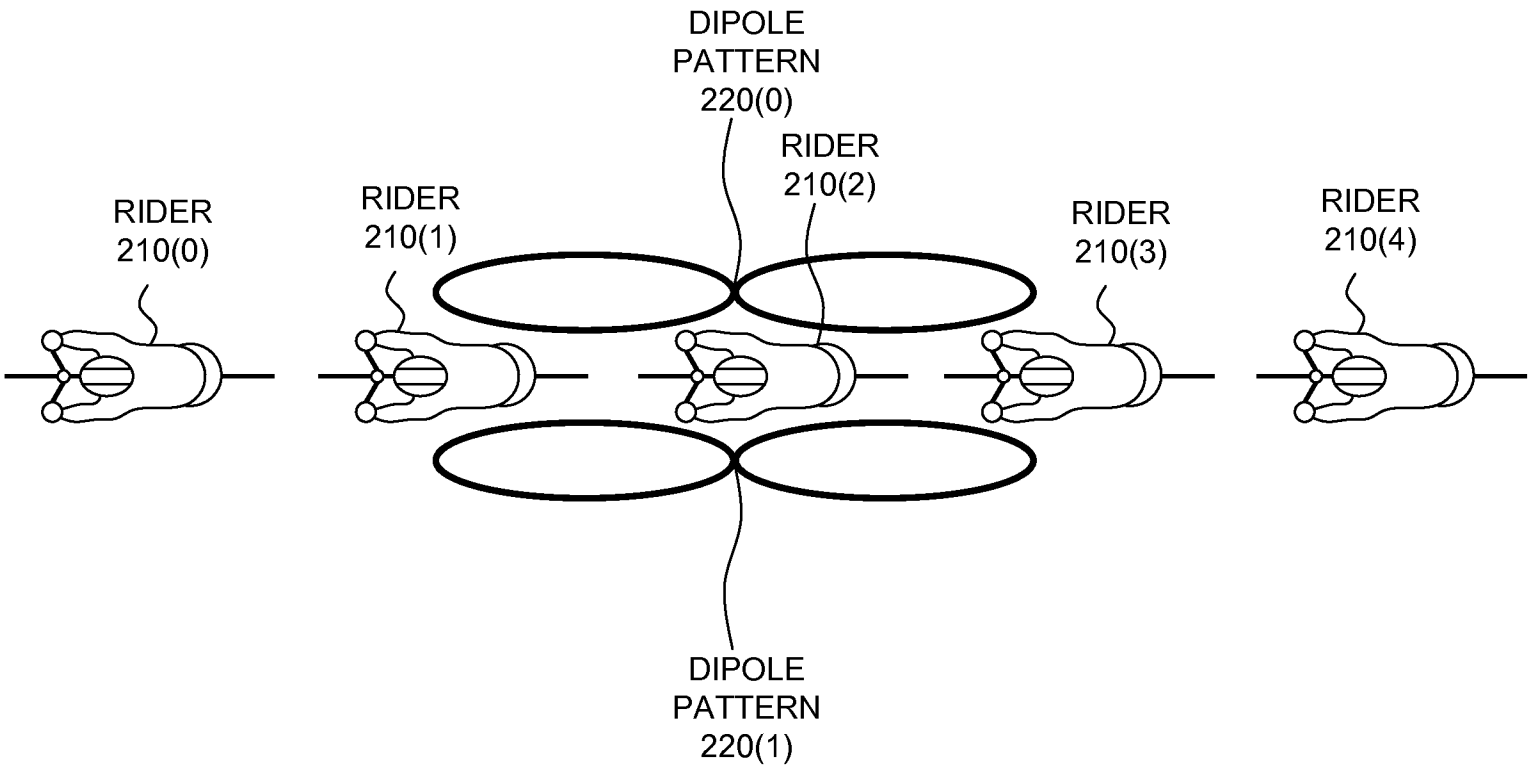
FIG. 2 conceptually illustrates one application of the audio processing system of FIG. 1, according to various embodiments.

FIG. 2 conceptually illustrates one application of the audio processing system of FIG. 1, according to various embodiments. As shown, riders 210(0), 210(1), 210(2), 210(3), and 210(4) are riding bicycles in a straight line. Rider 210(2) is wearing a personal listening device (not explicitly shown), that exhibits a dipole, or FIG. 8, pattern, as illustrated by dipole patterns 220(0) and 220(1). Dipole pattern 220(0) and dipole pattern 220(1) correspond to the right ear and the left ear of rider 210(2), respectively.

As illustrated, the distance of the outline of dipole pattern 220(0) and dipole pattern 220(1) from the right ear and the left ear of rider 210(2) indicates the signal strength as a function of angle. Bicycle riders often form pacelines, where bicyclists are directly in front/back of one another. This paceline pattern reduces the wind drag (since only the front rider is breaking the drag), and is also safer when there are cars in the road. Because rider 210(2) wears a personal listening device with a dipole pattern 220(0) and 220(1), rider 210(2) hears audio signals from front riders 210(0) and 210(1) and rear riders 210(3) and 210(4) more readily, relative to audio signals from the left side and right side of rider 210(2).

Figure 3:
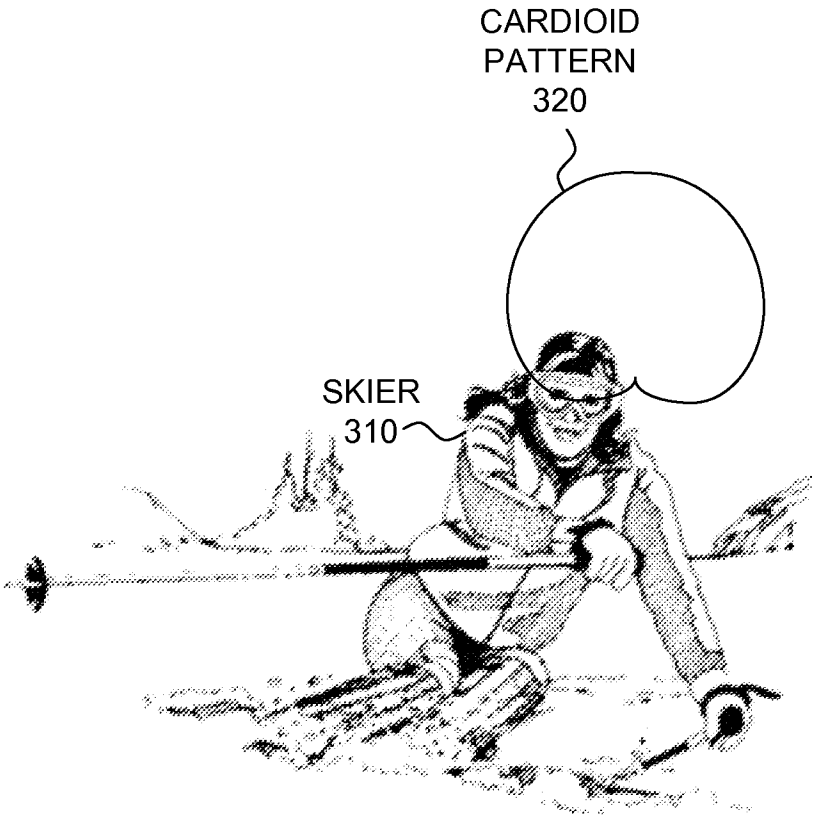
FIG. 3 conceptually illustrates another application of the audio processing system of FIG. 1, according to various other embodiments.

FIG. 3 conceptually illustrates another application of the audio processing system of FIG. 1, according to various other embodiments. As shown, skier 310, is wearing a personal listening device (not explicitly shown), that exhibits a cardioid pattern, as illustrated by cardioid pattern 320. Cardioid pattern 320 corresponds to the left ear of skier 310. For clarity, the cardioid pattern corresponding to the right ear of skier 310 is not explicitly shown in FIG. 3. As illustrated, the distance of the outline of cardioid pattern 320 from the left ear of skier 310 indicates the signal strength as a function of angle. Sounds from below skier 310, such as the sound of ski against snow and ice, are suppressed relative to sounds from other directions, including sounds originating from a lateral direction to or from above skier 310. The application illustrated in FIG. 3 is also relevant to other related activities, including, without limitation, snowboarding, running, and treadmill exercise.

Figure 4A:
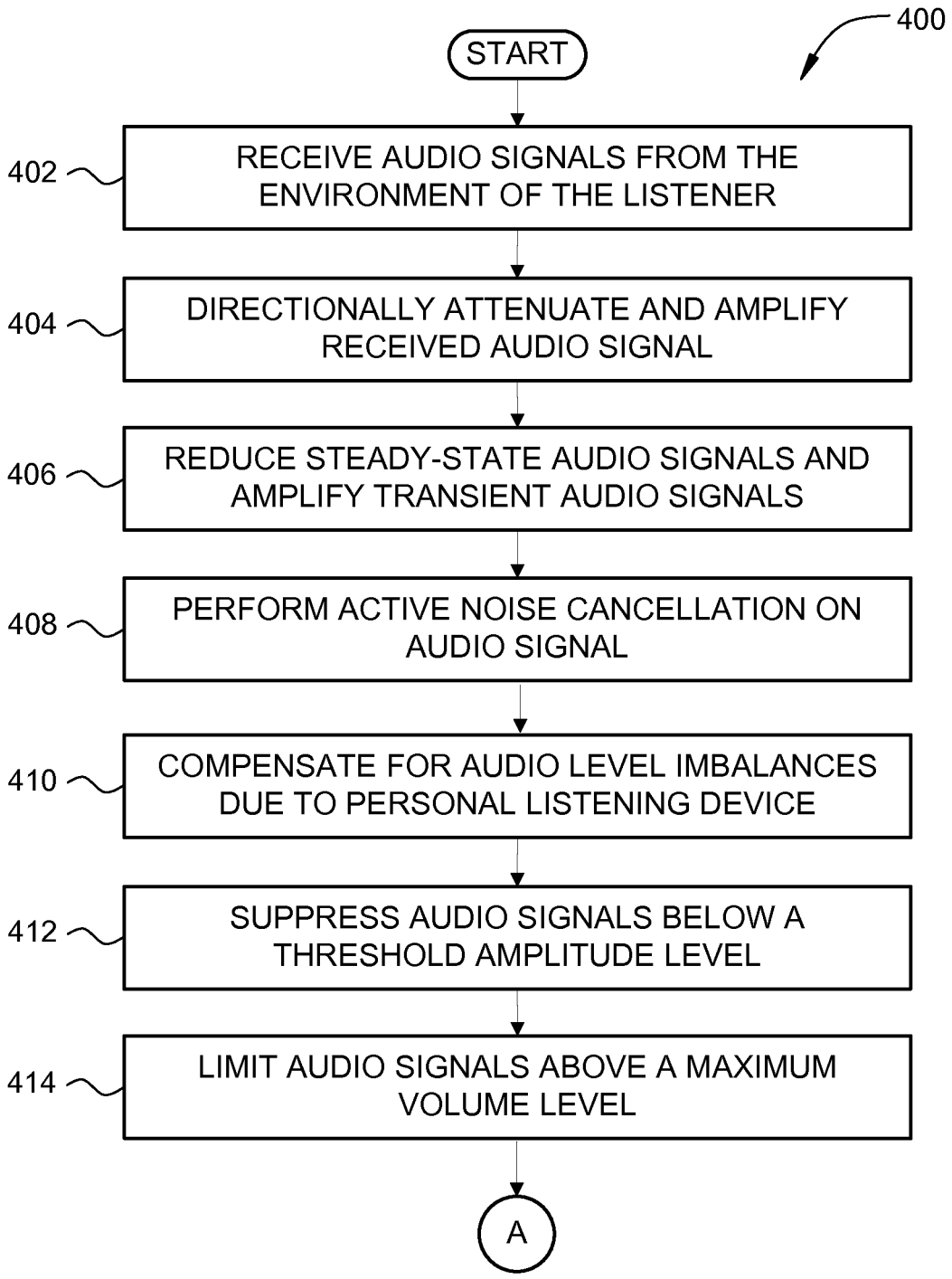
FIGS. 4A-4B is a flow diagram of method steps for processing playback and environmental audio signals, according to various embodiments.
Figure 4B:
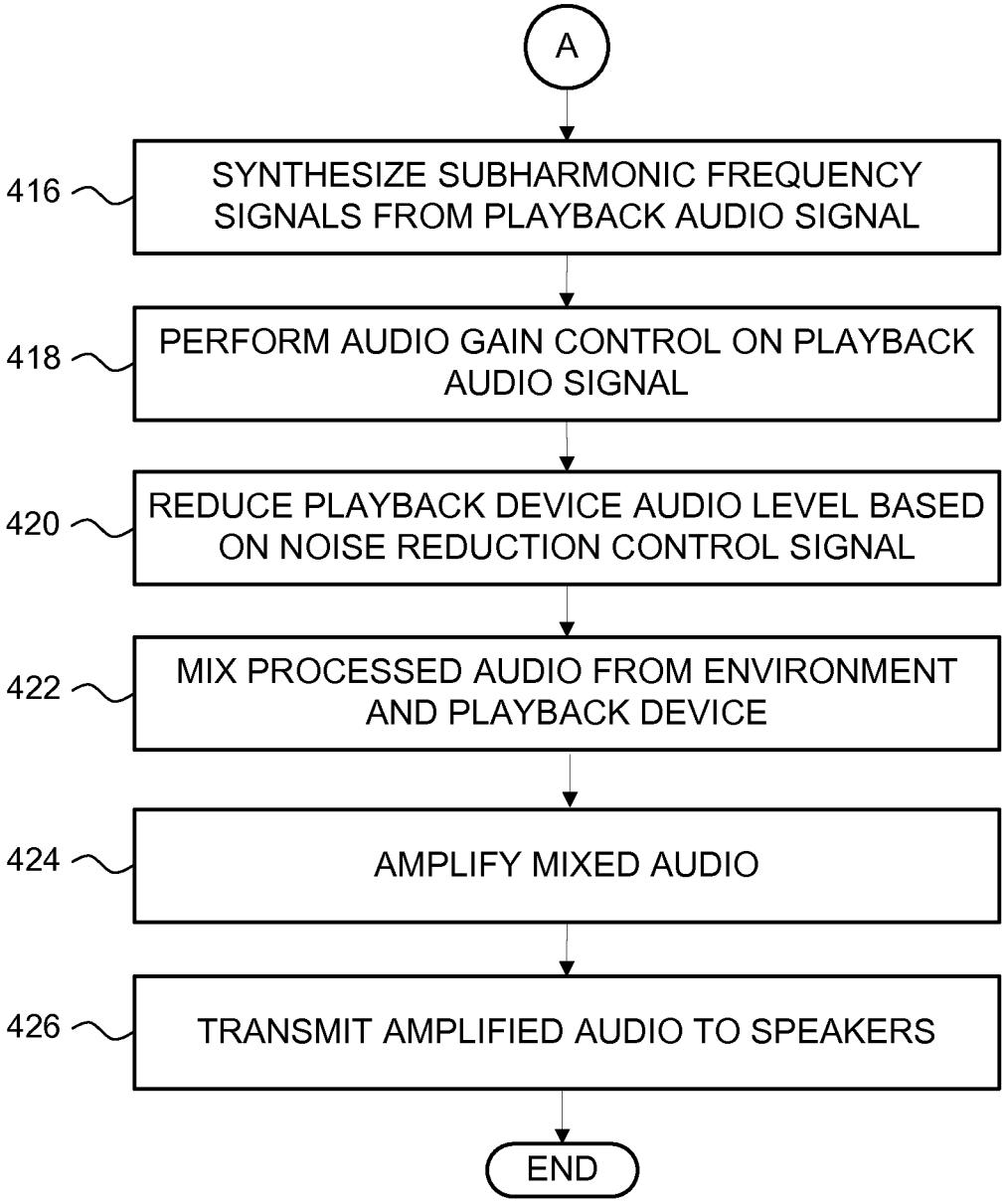

FIGS. 4A-4B set forth a flow diagram of method steps for processing playback and environmental audio signals, according to various embodiments. Although the method steps are described in conjunction with the systems of FIGS. 1-3, persons skilled in the art will understand that any system configured to perform the method steps, in any order, is within the scope of the present disclosure.

As shown, a method 400 begins at step 402, where microphone arrays 105(0) and 105(1) associated with an audio processing system 100 receive audio signals from the environment of a listener. At step 404, beamformers 110(0) and 110(1) directionally attenuate and amplify the audio signals from microphone arrays 110(0) and 110(1) according to a particular beamforming mode, including, without limitation, omnidirectional, dipole, and cardioid patterns. At step 406, noise reduction 115 reduces the audio levels of steady-state signals, such as hum, hiss, and wind, while amplifying the audio levels of transient signals, such as human speech, car horns, and alarms. At step 408, noise reduction 115 also performs active noise cancellation on part of the received audio signal. At step 410, equalizer compensates for frequency imbalances, such as imbalances associated with wearing headphones or earphones, relative to not wearing any personal listening device.

At step 412, gate 125 suppresses audio signals that are below a threshold volume or amplitude level. In some embodiments, gate 125 the threshold volume may be constant over the relevant frequency range. In other embodiments, the threshold volume may vary as a function of frequency. At step 414, limiter 130 attenuates audio signals that exceed a specified maximum allowable audio level. At step 416, subharmonic processing 155 synthesizes low frequency audio signals based on the audio signal feed received from a playback device. At step 418, automatic gain control 160 adjusts the volume of the audio signal feed received from the playback device. For example, and without limitation, automatic gain control 160 could increase the volume of quiet songs and could decrease the volume of loud songs. At step 420, ducker 165 temporarily reduces the volume of the audio signal feed received from the playback device based on a control signal from noise reduction 115 indicating that a source of interest is received from the environment of the listener.

At step 422, left mixer 135(0) and right mixer 135(1) mix the audio received from limiter 130 with the audio received from ducker 165 for the left and right channels, respectively. At step 424, left amplifier 140(0) and right amplifier 140(1) amplify audio signals received from left mixer 135(0) and right mixer 135(1), respectively. At step 426, left amplifier 140(0) and right amplifier 140(1) transmit the final audio signals to left speaker 145(0) and right speaker 145(1), respectively. The method 400 then terminates. In some embodiments, the method 400 does not terminate, but rather the components of the audio processing system 100 continue to perform the steps of method 400 in a continuous loop. In these embodiments, after step 426 is performed, the method 400 proceeds to step 402, described above. The steps of method 400 continue to be performed in a continuous loop until certain events occur, such as powering down a device that includes the audio processing system 100.

In sum, the disclosed techniques enable a listener using a personal listening device to hear a mix of music or other desired audio with certain sounds of interest from the environment of the listener. Steady state signals from the environment, such as hiss, hum, and traffic din, are removed from the audio environment while music and environmental sounds of interest are enhanced. Audio from the listener's environment are received via microphone arrays and processed by beamformers, noise reduction, equalization, gating, and limiting. Music and other audio signals received from a playback device are processed via subharmonic processing, automatic gain control, and ducking. Mixers perform a mix of the environmental audio and the playback audio, and transmit the resulting signals to amplifiers which, in turn, transmit the audio signals to speakers in a pair of headphones, earphones, earbuds, or other personal listening device.

At least one advantage of the approach described herein is that a listener who uses the disclosed personal listening device hears a high-quality audio signal from a playback device plus certain audio sounds of interest from the environment, while, at the same time, other sounds from the environment are suppressed relative to the sounds of interest. As a result, the potential for the listener to hear only desired audio signals is improved, leading to a better quality audio experience for the listener.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable The flowchart and block diagrams in the Figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the preceding is directed to embodiments of the present disclosure, other and further embodiments of the disclosure may be devised without departing from the basic scope thereof, and the scope thereof is determined by the claims that follow.

What is claimed is:

1. An audio processing system for a personal listening device, comprising:

a first plurality of microphones integrated into the personal listening device and configured to receive a first plurality of audio signals from an environment;

a noise reduction circuit coupled to the first plurality of microphones and configured to:

detect that a signal of interest is present in the first plurality of audio signals, by:

dividing the first plurality of audio signals into a plurality of frequency bins, and determining that at least one of the plurality of frequency bins is associated with an amplitude that fluctuates more than a threshold amount;

in response to determining that the at least one of the plurality of frequency bins is associated with an amplitude that fluctuates more than the threshold amount, amplify the at least one of the plurality of frequency bins; and upon detecting the signal of interest, transmit a ducking control signal;

an audio ducker coupled to the noise reduction circuit and configured to:

receive the ducking control signal, receive a second plurality of audio signals via a playback device, reduce an amplitude of the second plurality of audio signals relative to the signal of interest based on the ducking control signal; and a mixer coupled to the audio ducker and configured to combine the first plurality of audio signals and the second plurality of audio signals.

2. The audio processing system of claim 1, wherein the noise reduction circuit is further configured to:

determine that a first portion of the first plurality of audio signals corresponding to a first frequency band includes a noise signal; and reduce an amplitude of the first portion of the first plurality of audio signals.

3. The audio processing system of claim 1, wherein the noise reduction circuit is further configured to:

determine that a first portion of the first plurality of audio signals corresponding to a first frequency band includes the signal of interest; and amplify the first portion of the first plurality of audio signals.

4. The audio processing system of claim 1, further comprising an equalizer configured to perform frequency-based amplitude adjustments on the first plurality of audio signals to compensate for an acoustic change resulting from a physical characteristic of the personal listening device.

5. The audio processing system of claim 1, further comprising a gate configured to:

determine that a first portion of the first plurality of audio signals is below a threshold amplitude; and reduce an amplitude of the first portion of the first plurality of audio signals.

6. The audio processing system of claim 1, further comprising a limiter configured to:

determine that a first portion of the first plurality of audio signals is above a maximum allowable amplitude; and limit an amplitude of the first portion of the first plurality of audio signals to be no greater than the maximum allowable amplitude.

7. The audio processing system of claim 1, further comprising a subharmonic processor configured to:

synthesize one or more subharmonic signals corresponding to at least a portion of the second plurality of audio signals to generate a third plurality of audio signals; and combine the second audio signals with the third plurality of audio signals.

8. The audio processing system of claim 1, further comprising an automatic gain controller configured to:

calculate a target audio level corresponding to the second plurality of audio signals;

determine that at least a portion of the second plurality of audio signals differs from the target audio level;

calculate a scaling factor such that, when the second plurality of audio signals are multiplied by the scaling factor, the resulting audio signals are closer to the target audio level; and multiply the second plurality of audio signals by the scaling factor.

9. The audio processing system of claim 1, wherein the signal of interest comprises an intermittent audio sound having a high audio level relative to an average audio signal level associated with the first plurality of audio signals.

10. The audio processing system of claim 9, further comprising an amplifier configured to:

amplify the first plurality of audio signals; and transmit the first plurality of audio signals to a speaker to generate sound output.

11. A method for processing playback and environmental audio signals, the method comprising:

receiving a first plurality of audio signals from an environment;

detecting that a signal of interest is present in the first plurality of audio signals, wherein the signal of interest comprises an intermittent audio sound having a high audio level relative to an average audio signal level associated with the first plurality of audio signals, by:

dividing the first plurality of audio signals into a plurality of frequency bins, and determining that at least one of the plurality of frequency bins is associated with an amplitude that fluctuates more than a threshold amount;

in response to determining that the at least one of the plurality of frequency bins is associated with an amplitude that fluctuates more than the threshold amount, amplifying the at least one of the plurality of frequency bins;

upon detecting the signal of interest, generating a ducking control signal;

receiving a second plurality of audio signals via a playback device;

reducing an amplitude of the second plurality of audio signals relative to the signal of interest based on the ducking control signal; and combining the first plurality of audio signals and the second plurality of audio signals.

12. The method of claim 11, further comprising:

identifying a direction from where the first plurality of audio signals is originating; and attenuating the first plurality of audio signals based on the direction.

13. The method of claim 12, wherein attenuating the first plurality of audio signals comprises:

receiving a selection of a beamforming mode;

calculating a scaling factor based on the beamforming mode and the direction; and applying the scaling factor to the first plurality of audio signals.

14. The method of claim 13, wherein the beamforming mode comprises an omnidirectional mode, a dipole mode, or a cardioid mode.

15. The method of claim 11, further comprising:

determining that a first portion of the first plurality of audio signals corresponding to a first frequency band includes a noise signal; and reducing an amplitude of the first portion of the first plurality of audio signals.

16. The method of claim 11, further comprising:

determining that a first portion of the first plurality of audio signals corresponding to a first frequency band includes the signal of interest; and amplifying the first portion of the first plurality of audio signals.

17. A non-transitory computer-readable storage medium including instructions that, when executed by a processor, cause the processor to process playback and environmental audio signals, by performing the steps of:

receiving a first plurality of audio signals from an environment;

detecting that a signal of interest is present in the first plurality of audio signals, wherein the signal of interest comprises an intermittent audio sound having a high audio level relative to an average audio signal level associated with the first plurality of audio signals, by:

dividing the first plurality of audio signals into a plurality of frequency bins, and determining that at least one of the plurality of frequency bins is associated with an amplitude that fluctuates more than a threshold amount;

in response to determining that the at least one of the plurality of frequency bins is associated with an amplitude that fluctuates more than the threshold amount, amplifying the at least one of the plurality of frequency bins;

upon detecting the signal of interest, generating a ducking control signal;

receiving a second plurality of audio signals via a playback device;

reducing an amplitude of the second plurality of audio signals relative to the signal of interest based on the ducking control signal; and combining the first plurality of audio signals and the second plurality of audio signals.

18. The non-transitory computer-readable storage medium of claim 17, further including instructions that, when executed by the processor, cause the processor to perform the steps of:

identifying a direction from where the first plurality of audio signals is originating; and attenuating the first plurality of audio signals based on the direction.

19. The non-transitory computer-readable storage medium of claim 18, wherein attenuating the first plurality of audio signals comprises:

receiving a selection of a beamforming mode;

calculating a scaling factor based on the beamforming mode and the direction; and applying the scaling factor to the first plurality of audio signals.

20. The non-transitory computer-readable storage medium of claim 19, wherein the beamforming mode comprises an omnidirectional mode, a dipole mode, or a cardioid mode.

* * * * *